US006056395A

United States Patent [19]

Liu

[11] Patent Number: 6,056,395

[45] Date of Patent: May 2, 2000

[54] DEVICE TO PREVENT FROM INK INTERRUPTION IN A PRINTING HEAD OF AN INK CARTRIDGE IN A PRINTER

[76] Inventor: Win-Yin Liu, P.O. Box 96-405, Taipei 10098, Taiwan

[21] Appl. No.: 09/218,047

[22] Filed: Dec. 22, 1998

[51] Int. Cl.[7] ..... B41J 2/19

[52] U.S. Cl. ..... 347/92

[58] Field of Search ..... 347/84, 85, 86, 347/87, 92, 29, 30

[56] References Cited

U.S. PATENT DOCUMENTS

| | | | |
|---|---|---|---|
| 5,329,294 | 7/1994 | Ontawar et al. | 347/87 |
| 5,515,663 | 5/1996 | Allgeier, Sr. et al. | 347/87 |
| 5,595,223 | 1/1997 | Hayao | 347/87 |
| 5,596,354 | 1/1997 | Murphy | 347/30 |
| 5,706,870 | 1/1998 | Maerzke | 347/85 |
| 5,883,652 | 5/1996 | Moser et al. | 347/85 |

*Primary Examiner*—N. Le
*Assistant Examiner*—Anh T. N. Vo
*Attorney, Agent, or Firm*—Dougherty & Troxell

[57] ABSTRACT

A device for preventing from ink interruption in a printing head of an ink cartridge in a printer; the prime feature thereof is to suck out air in a second chamber of a printing head after the ink of an ink cartridge of a jet printer is used up, and the prime chamber of the ink cartridge will be refilled with ink; a suck assembly has a hermetic assembly to be in close contact with an outer flat surface of the printing head of the ink cartridge; then, a compression unit can provide a vacuum-pumping effect to suck out air in the second chamber completely so as to prevent the spraying unit of the printing head from having ink interruption.

8 Claims, 15 Drawing Sheets

DEVICE TO PREVENT FROM INK INTERRUPTION IN A PRINTING HEAD OF AN INK CARTRIDGE IN A PRINTER

BACKGROUND OF THE INVENTION

1. Field of the Invention

This invention relates to an ink cartridge of a jet printer, and particularly to a device for preventing from ink interruption in a printing head of an ink cartridge in a printer 2. Description of the Prior Art In the conventional jet printer, the ink is loaded in a cartridge, and the ink jetted on the printing paper is controlled with a sparager; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying inks. The ink cartridge supplied by the original manufacturer usually has an equal pressure in the ink chamber during the automatic manufacturing process, and there will be no leak during printing operation.

When refilling ink into a conventional hollow ink cartridge, and if such ink cartridge is furnished with an equalization air-bladder in the ink chamber thereof, a sticky tape should be used to close the air vent of the maze passage on the bottom of the ink cartridge so as to prevent ink from leaking; then, the intake hole of the air-bladder should also be closed with sticky tape so as to maintain equalization of pressure; then, use a sharp point to press the seal bead out of its position so as to provide a refilling hole. Take a suitable amount of ink with a syringe, and then inject the ink into the refilling hole on the ink cartridge slowly until the cartridge being full; use a plastic plug to seal the refilling hole, and then tear off the sticky tapes on the intake hole and on the bottom of the ink cartridge respectively; it is quite often that the opening end of the maze passage or the jet nozzle will have a leakage of ink after the sticky tape on the bottom of cartridge being removed because of the pressure in the ink chamber not being equalized. To overcome such leakage, the only method is to rub off the ink leaked slowly until the leak stopped.

The air bladder of the ink cartridge is usually furnished in the prime chamber; a second chamber is furnished between the prime chamber and the printing head. Between the two chambers, there is a fine mesh used for balancing the pressure difference thereof so as to have the ink flowed evenly into the storage chamber of the sprayer in the printing head, and also to prevent impurities in the ink of prime chamber from entering the second chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

SUMMARY OF THE INVENTION

The prime object of the present invention is to provide a device to prevent from ink interruption in the ink cartridge; when ink in the ink cartridge is used up, new ink will be refilled into the prime chamber of the ink cartridge; at the same time, the air in the second chamber in the printing head is unable to be exhausted, and therefore a hermetic assembly of a suck assembly will be connected closely on an outer flat surface of the printing head to suck out the air therein by means of a vacuum-pumping method; as soon as the air in the second chamber is sucked out, no ink interruption will take place.

Another object of the present invention is to provide a device to prevent from ink interruption in the ink cartridge, in which the outer flat surface of the printing head is closely attached with the hermetic assembly of the suck assembly, and then the suck assembly will be compressed to provide a vacuum-pumping effect to suck air out of the second chamber.

Still another object of the present invention is to provide a device to prevent from ink interruption in the ink cartridge, in which the center of the hermetic assembly connected with the outer surface of the printing head has a through hole, of which the outer edge is furnished with a rectangular hermetic-connection ring to connect closely with the flat surface of the printing head of the ink cartridge. The rim of the hermetic-connection ring has a second hermetic surface with a suitable height to fit for the shape of the printing head. When the hermetic assembly faces the printing head for connection, the second hermetic surface will connect with the outer edge of the printing head of the ink cartridge; the central hermetic-connection ring will directly be attached to the flat surface of the printing head so as to suck air out of the second chamber.

A further object of the present invention is to provide a device to prevent from ink interruption in the ink cartridge, in which the hermetic-connection ring in the center of the hermetic assembly of the suck assembly is designed to fit the outer edge of the hole plate of the printing head; the hermetic assembly is mounted around the flat surface of the hole plate of the outer edge of the spray hole by means of the hermetic-connection ring so as to provide a complete hermetic effect; by means of the vacuum-pumping method of the suck assembly, air in the second chamber of the ink cartridge can be sucked out completely.

A still further object of the present invention is to provide a device to prevent from ink interruption in the ink cartridge, in which a resilient hermetic-connection ring in the center of the hermetic assembly is designed to fit the flat surface to the circuit protection layer on outer edge of the bearing surfaces on both sides of the printing head so as to suck air out of the second chamber by means of the vacuum-pumping effect of the suck assembly.

Yet another object of the present invention is to provide a device to prevent from ink interruption in the ink cartridge, in which the second hermetic surface furnished on outer edge of the hermetic assembly of the suck assembly is designed to fit the shape of the body part around the printing head of the ink cartridge. When the surface faces the body part of the printing head for connection, it can guide the hermetic-connection ring and the outer flat surface of the hole plate on the printing head to connect together quickly so as to strengthen the second close connection between the suck assembly and the printing head.

Yet still another object of the present invention is to provide a device to prevent from ink interruption in the ink cartridge, in which the second hermetic surface on outer edge of the hermetic assembly of the suck assembly is designed to have a same height so as to connect directly around the rim of the body part outside the printing head of the ink cartridge, and it has a rectangular hermetic surface to be used for a second close connection around the rim of the printing head.

Yet a further object of the present invention is to provide a device to prevent from ink interruption in the ink cartridge, in which the second hermetic surface on outer edge of the hermetic assembly of the suck assembly is designed to have a similar height of flat surface on both sides of the hermetic-connection ring in the center of the hermetic assembly; on other two sides of the hermetic-connection ring, there are rectangular higher and a suitable thick wall surfaces; the width of the two wall surfaces are designed to fit the width of the body part of the printing head in the ink cartridge. The distance between the two wall surfaces can provide a positioning guidance for the hermetic assembly, and also provide a better hermetic connection between the two surfaces and the rim of the printing head.

Yet a still further object of the present invention is to provide a device to prevent from ink interruption in the ink cartridge, in which the hermetic assembly of the suck assembly is furnished with a hermetic-connection ring and a second hermetic surface so as to be connected with the printing head hermetically; the center of the hermetic assembly has a through hole, of which one end is designed to fit the shape of the bottle mouth of the ink bottle so as to have them connected together hermetically. The hermetic assembly should be connected with the body part of the printing head together in advance. Compress the empty ink bottle so as to have he bottle mouth of the ink bottle and the through hole in the hermetic assembly connected hermetically, and then suck air out of the second chamber by means of a vacuum-pumping method.

Yet again a further object of the present invention is to provide a device to prevent from ink interruption in the ink cartridge, in which the hermetic assembly of the suck assembly is furnished with a hermetic-connection ring and a second hermetic surface to be in close connection with the printing head of the ink cartridge, and the center of the hermetic assembly has a through hole, of which one end has a cylinder portion with a suitable diameter. The bottom of the cylinder portion is furnished with a ring-shaped groove. The cylinder portion and the ring-shape groove are used for connecting with the compression unit that is substantially a compression ball; when the compression ball is compressed, a vacuum-pumping force will be generated to suck air out of the second chamber of the ink cartridge completely.

DETAILED DESCRIPTION OF THE PREFERRED EMBODIMENT

Figure 1:
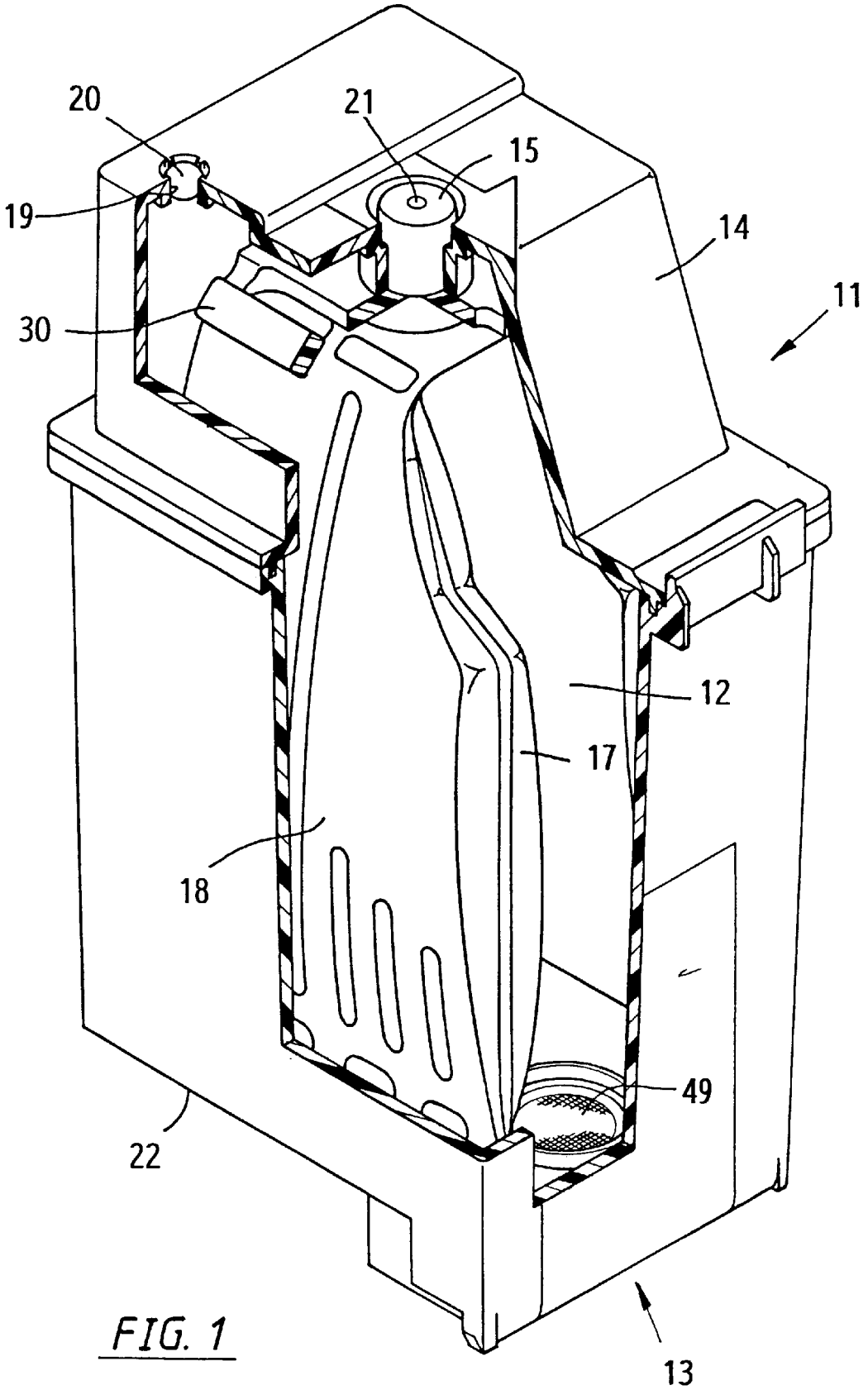
FIG. 1 is a perspective and sectional view of an ink cartridge, showing the inner structure thereof.
Figure 2:
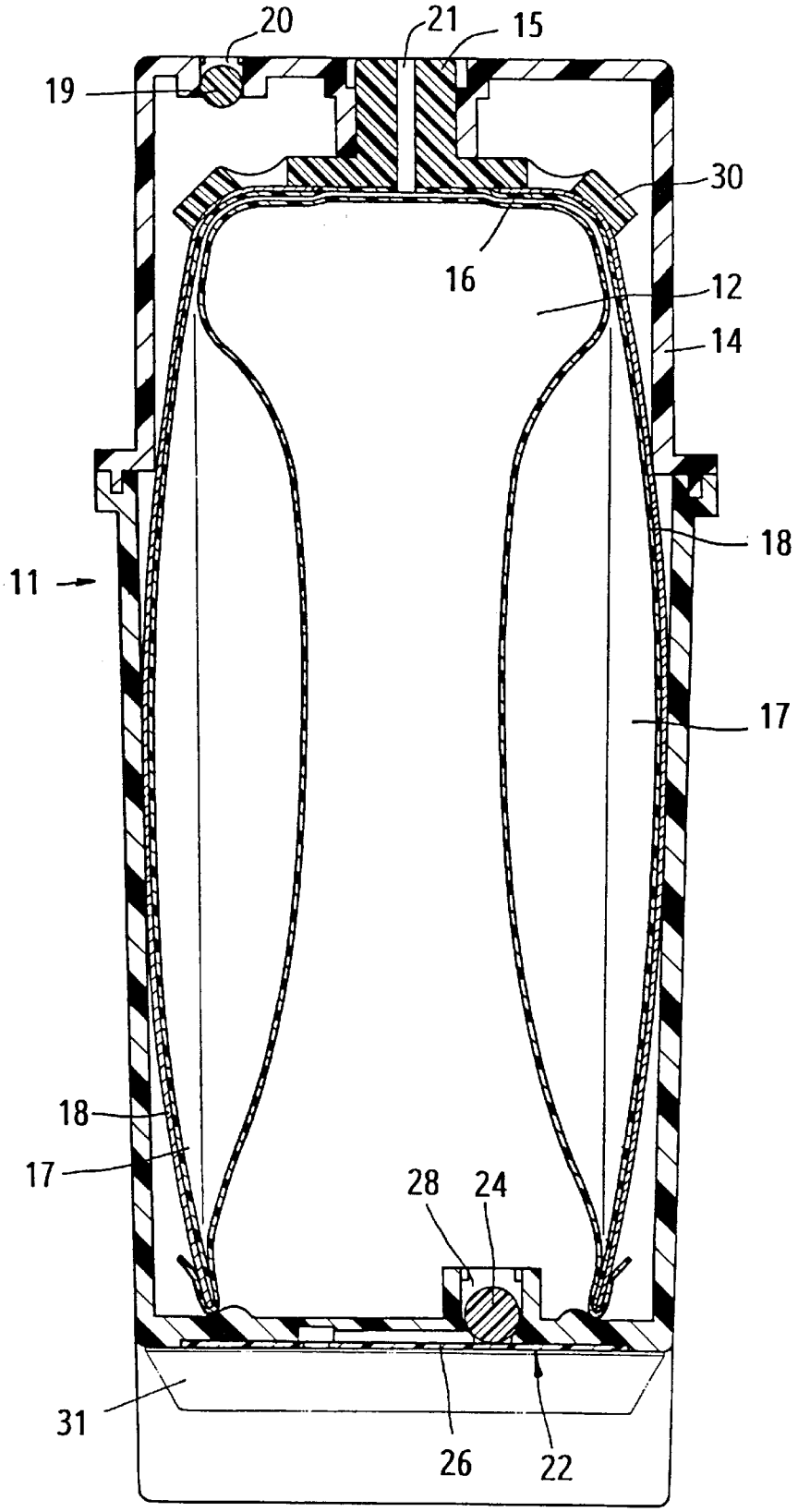
FIG. 2 is a sectional view of the ink cartridge, showing the inner structure thereof.
Figure 3:
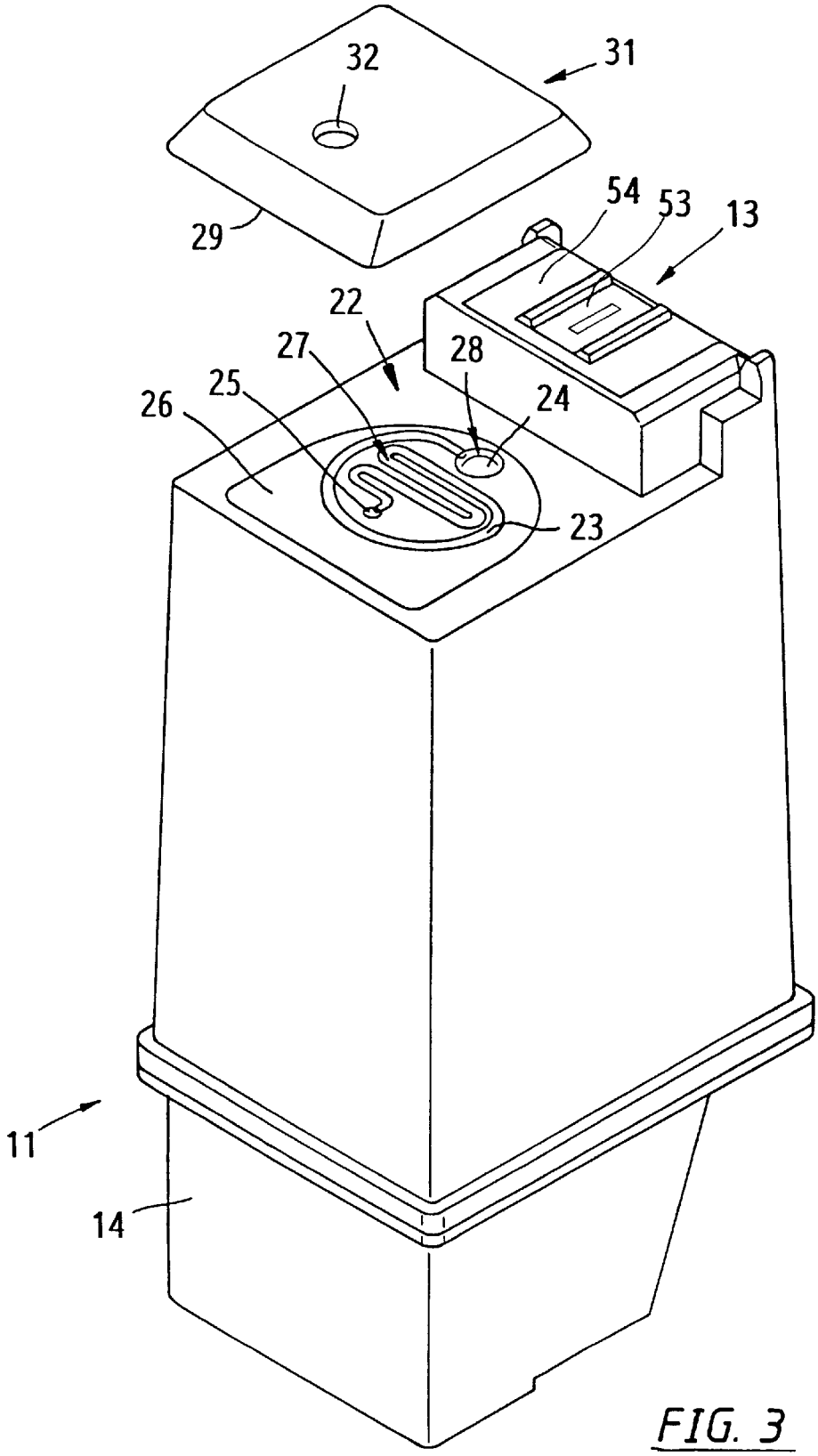
FIG. 3 is an outer view of the ink cartridge, showing the relation between the rubber piece and the flat bottom of the ink cartridge.

Referring to FIGS. 1 to 3, an ink cartridge 11 for a jet printer (HP 51626A) is shown; before refilling the ink cartridge 11, the structure thereof must be understood. In the ink cartridge 11, there are two symmetrical air-bladders 17 and two pressing plates 18; there is a supporting plate 30 mounted on the upper ends of the air-bladders and the pressing plates 18 and the plate 30 is fastened to a cylinder 15; the cylinder 15 is fixed in a round hole of a body part 14 of the ink cartridge 11. The center of the cylinder 15 has an intake hole 21 to allow air to enter the air bladders 17 via a passage 16. The pressing plates 18 is made a thin metal plate, having a suitable force for regulating the variation of the air-bladders 17; a refilling hole 19 is furnished at one side of the top of body part 14 to facilitate filling ink into the ink chamber 12 of the ink cartridge 11. As soon as the ink chamber 12 is fully filled with ink, the refilling hole 19 should be sealed with a plastic bead 20 so as to separate the ink from the atmospheric pressure. The flat bottom 22 of the ink cartridge 11 is provided with a maze groove 23, of which one end has a cylindrical hole 28 filled with a regulating bead 24; there is a very fine passage 29 furnished between the regulating bead 24 and the inner surface of the cylindrical hole 28. The maze groove 23 is covered with a membrane 26 to form into a maze passage 27. The other end of the maze passage 27 connects with an air vent 25 in communication with the atmosphere. The ink pressure in the ink chamber 12 can be equalized by means of the maze passage 27 and the air-bladders 17 to prevent the ink from leaking out of the jet nozzle 13 of the ink cartridge 11.

Figure 5:
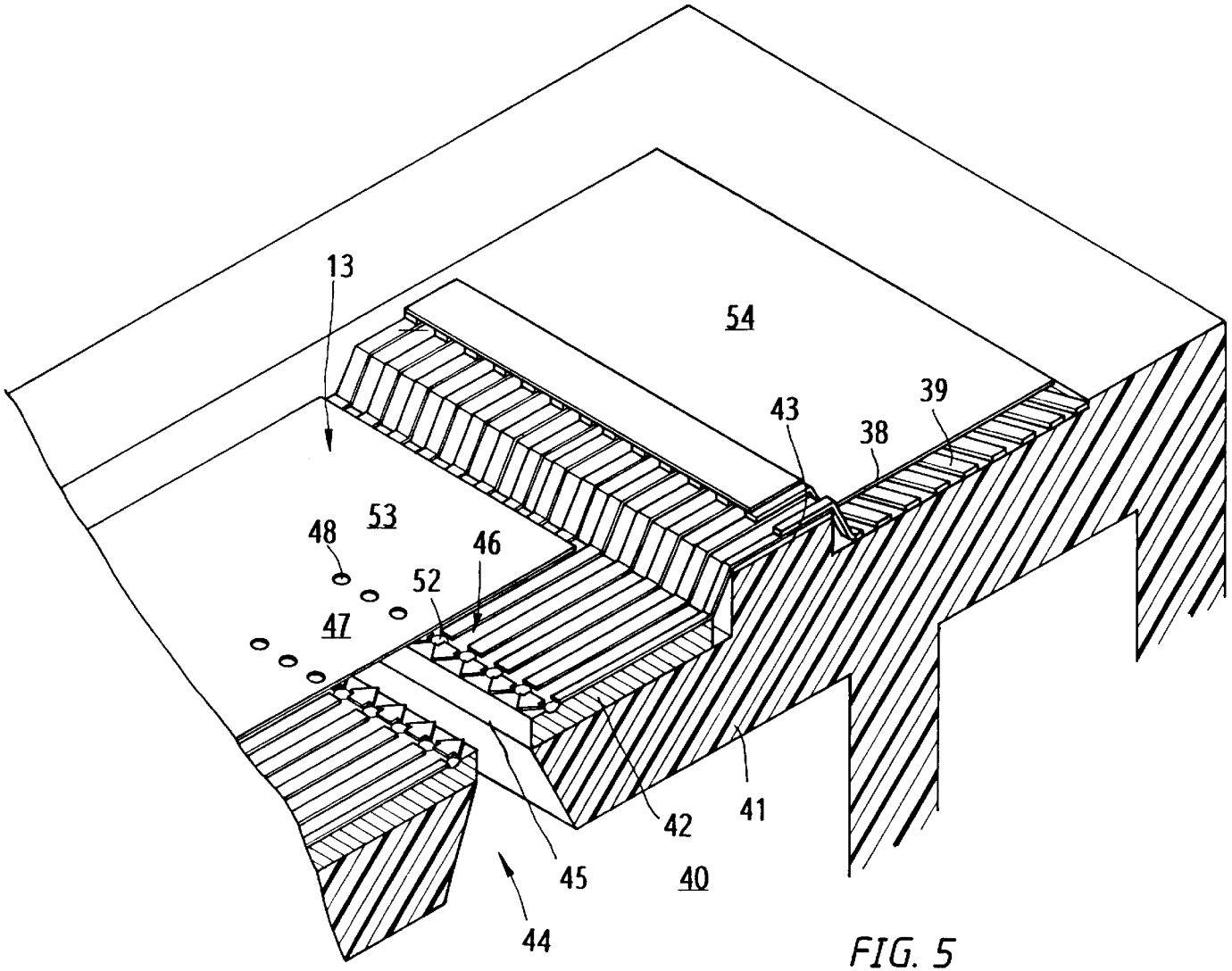
FIG. 5 is a sectional view of a printing head of the ink cartridge, showing the structure thereof.

Referring to FIGS. 1 and 5, there is a second chamber 40 furnished between the prime chamber 12 and the printing head 13 of the ink cartridge 11. The two chambers 12 and 40 are isolated with a fine mesh 49 so as to reduce the pressure difference between the two chambers 12 and 40. The body part 41 under the second chamber 40 is furnished with an outlet port 44, which is in communication with a passage 45 defined by an outer bearing member 42 on outer surface of the body part 41; the ink will flow, through the passage 45, into the storage chamber 52 of the sprayer 46; such passage can prevent impurities matters from entering the second chamber 40, and enable the ink to flow into every storage chamber 52 of the sprayer 46 uniformly as well. The hole plate 47 of the printing head 13 in the ink cartridge 11 is furnished with a plurality of spray holes 48 arranged regularly; every sprayer hole 48 is located on outer edge of the storage chamber 52 of the sprayer 46. A circuit assembly 39 can send out a signal for controlling the sprayer 46 to spray ink out of the spray holes 48.

The printing head 13 is mounted with a hole plate 47 with spray holes 48. There is a suitable flat surface 53 furnished around the spray holes 48. The flat surface 53 is slightly lower than the bearing surfaces 43 on both sides of the flat surface. The outer edge of the bearing surface 43 is furnished and fastened with electric contacts of the sprayer 46; and the electric contacts are connected with a connector on the ink cartridge through the electric assembly 39. The outside of the electric assembly 39 is covered with a protection layer 38 fastened on the body of the ink cartridge 11; the protection layer 38 has a wide flat surface 54.

Figure 4:
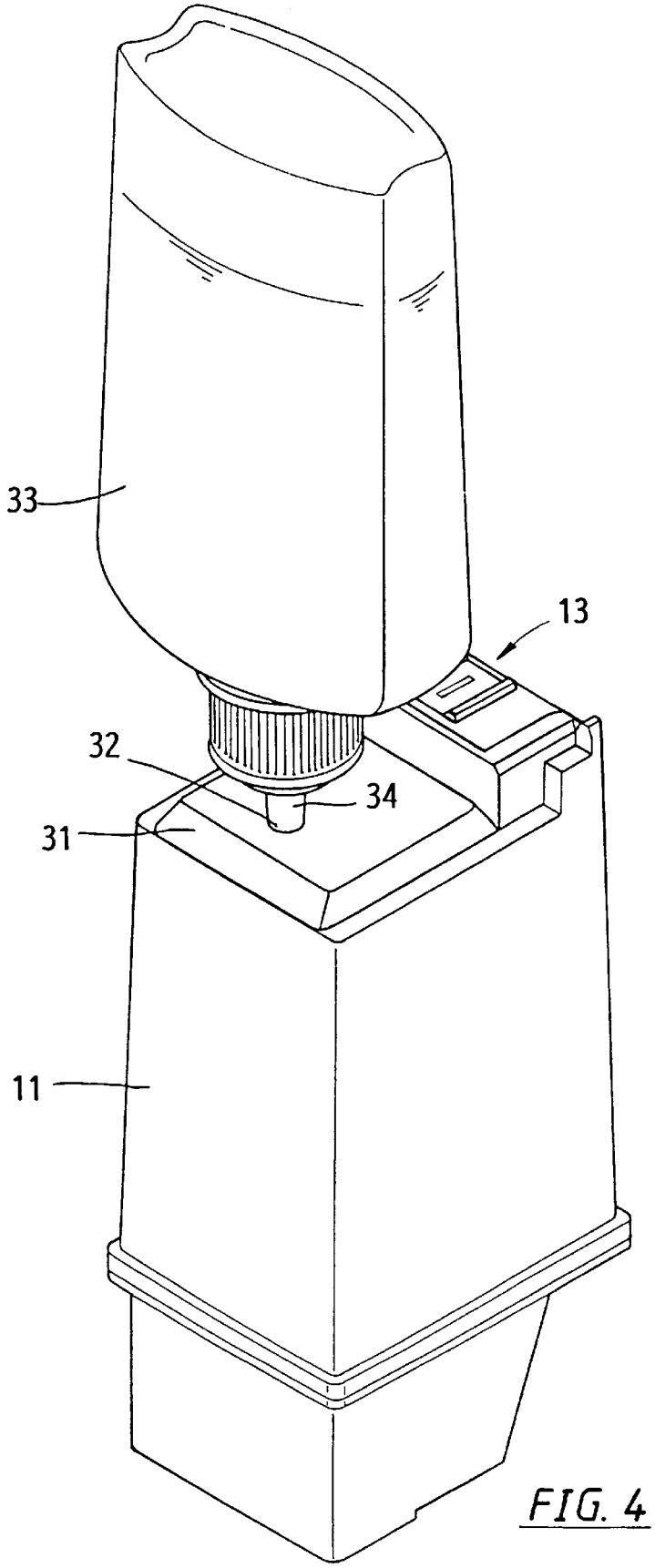
FIG. 4 is a perspective view of the ink cartridge, showing the ink bottle mounted reversely.

The structure of the prime chamber 12 and the printing head 13 of the air-bladder type of ink cartridge 11 has been described above. When ink in the ink cartridge 11 is used up, cartridge 11 can be refilled, by means of a vacuum-refilling method, through a maze passage 27 and an air vent 25 on the flat bottom 22 of the ink cartridge 11, and the ink pressure in the prime chamber 12 of the ink cartridge 11 will have a better balance. The ink-refilling method as shown in FIGS. 3 and 4 has been described in a pending patent application, No. 09/002,110, under the title of "A Refilling Device for Ink Cartridge of A Jet Printer"; without changing and damaging the ink cartridge 11, a rubber piece 31 with a glue tape 29 is glued on a membrance 26 around the maze passage 27. The rubber piece 31 has a refilling hole 32 in alignment with the air vent 25 of the maze passage 27; the refilling hole 32 is to be connected with the bottle mouth 34 of the ink bottle 33, and the ink therein is to be injected into the prime chamber 12 of the ink cartridge 11 by squeezing the ink bottle 33. As soon as the ink bottle 33 is released, air inside the prime chamber 12 will be sucked out until the ink in the ink bottle 33 being used up, i.e., the ink bottle 33 being used to suck out the residual air in the prime chamber 12; then, the pressure in the prime chamber 12 is in a balance condition, which would not cause the ink to leak out.

The ink-refilling is usually made during the ink cartridge 11 showing a poor printing, i.e., the ink in the second chamber 40 is running short; in that case, the passage 45 delined by the bearing member 42 is unable to have the ink flowed into the storage chamber 52 of the sprayer 46. The ink newly refilled in the prime chamber 12 would not flow directly into the second chamber 40 because of the blockade of the mesh 49 and the pressure-balance effect; however, the ink in the prime chamber 12 of the ink cartridge is still unable to let the printer print better documents.

Referring to FIGS. 5 to 9, this invention relates to a device to prevent from ink interruption in a printing head of an ink cartridge in a printer; the prime feature is that, after ink being refilled into the prime chamber 12 of the ink cartridge 11, the residual air in the second chamber 40 of the printing head 13 can be sucked out by means of a suck assembly 59, of which the hermetic assembly 61 is hermetically connected with the flat surface of the printing head 13 before sucking the residual air out of the second chamber 40 completely by means of vacuum-pumping method.

Figure 6:
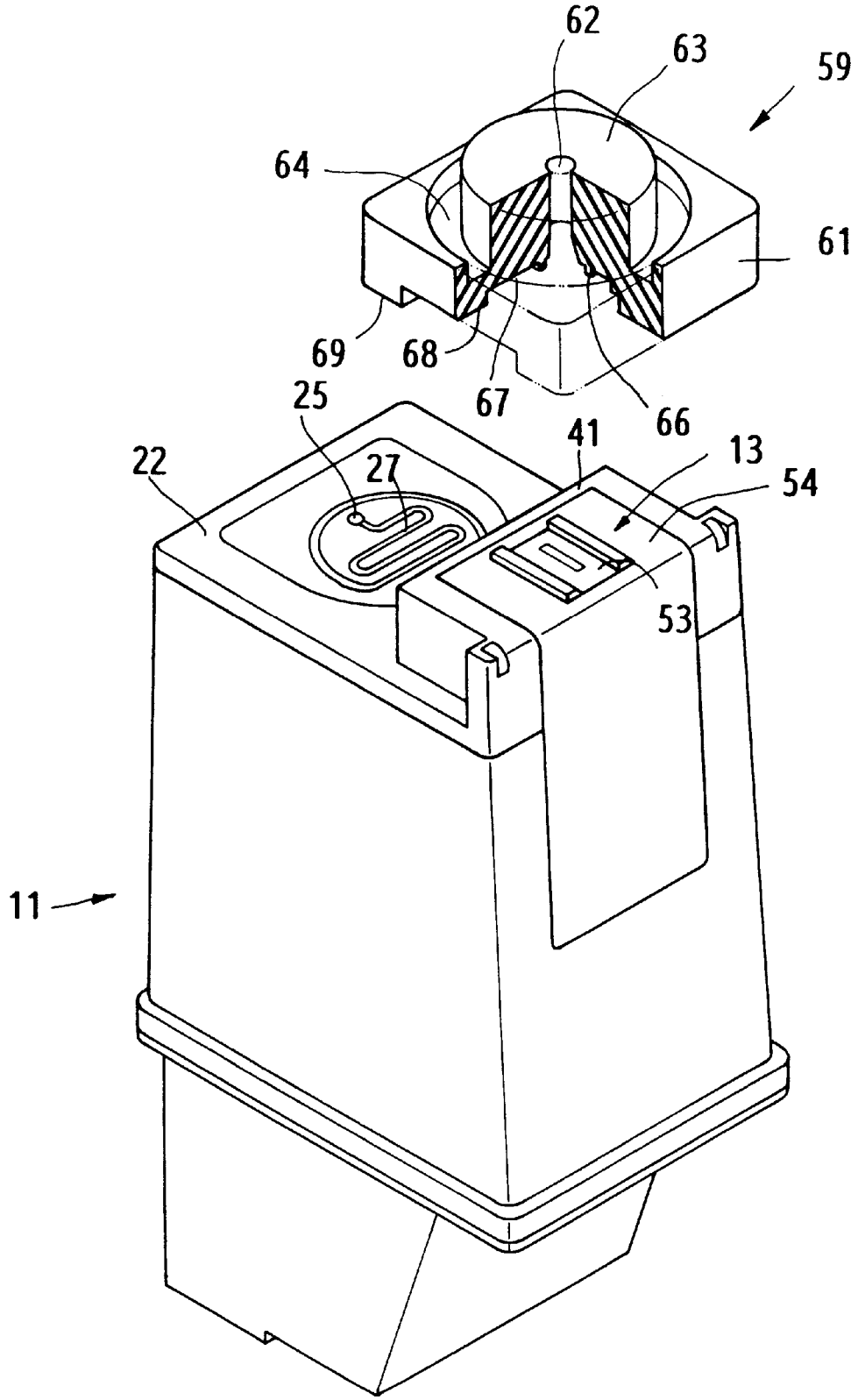
FIG. 6 is a perspective view of the present invention, showing the relation between the suck assembly and the ink cartridge.
Figure 7:
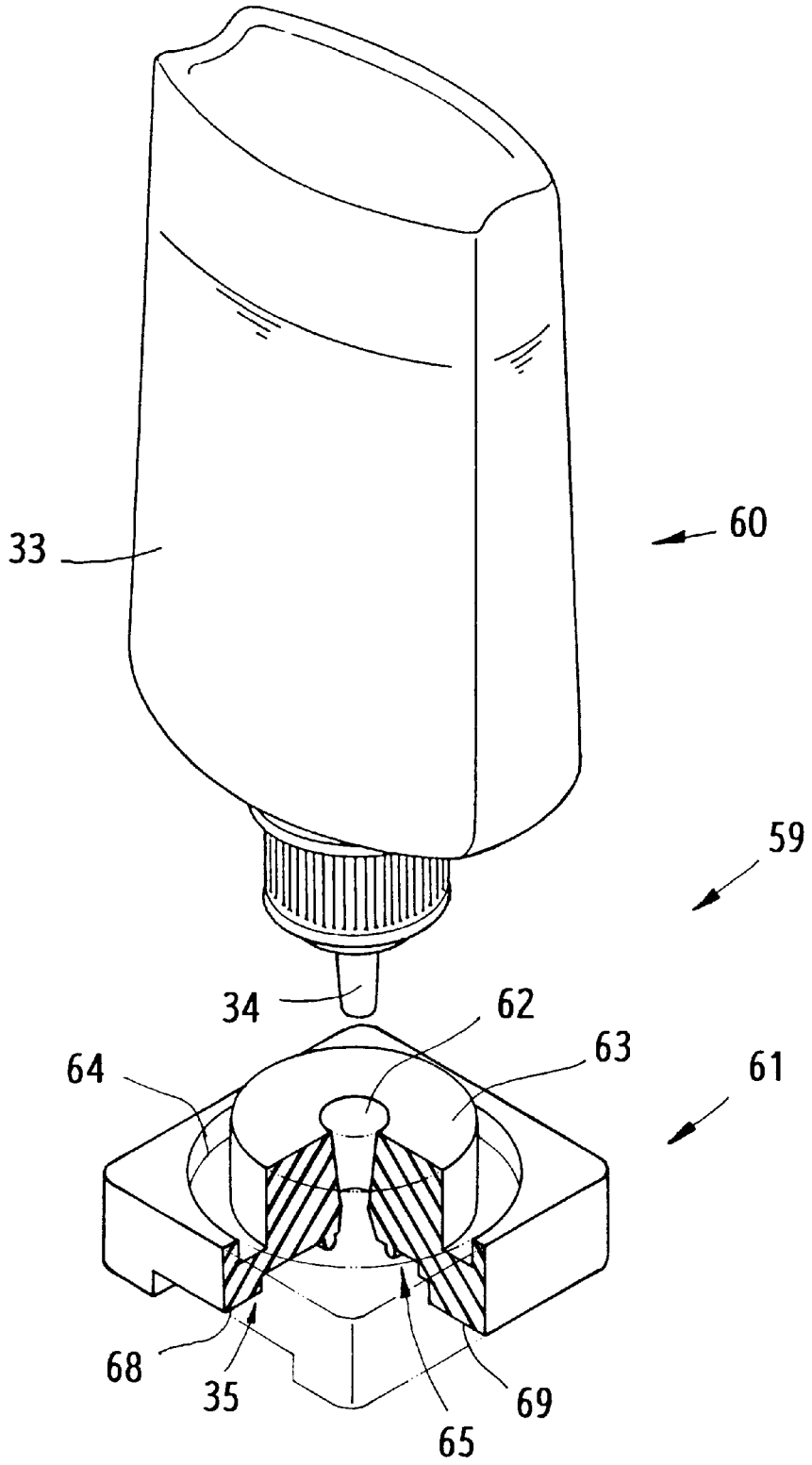
FIG. 7 is a perspective and sectional view the present invention, showing an empty ink bottle used as a suck assembly.
Figure 8:
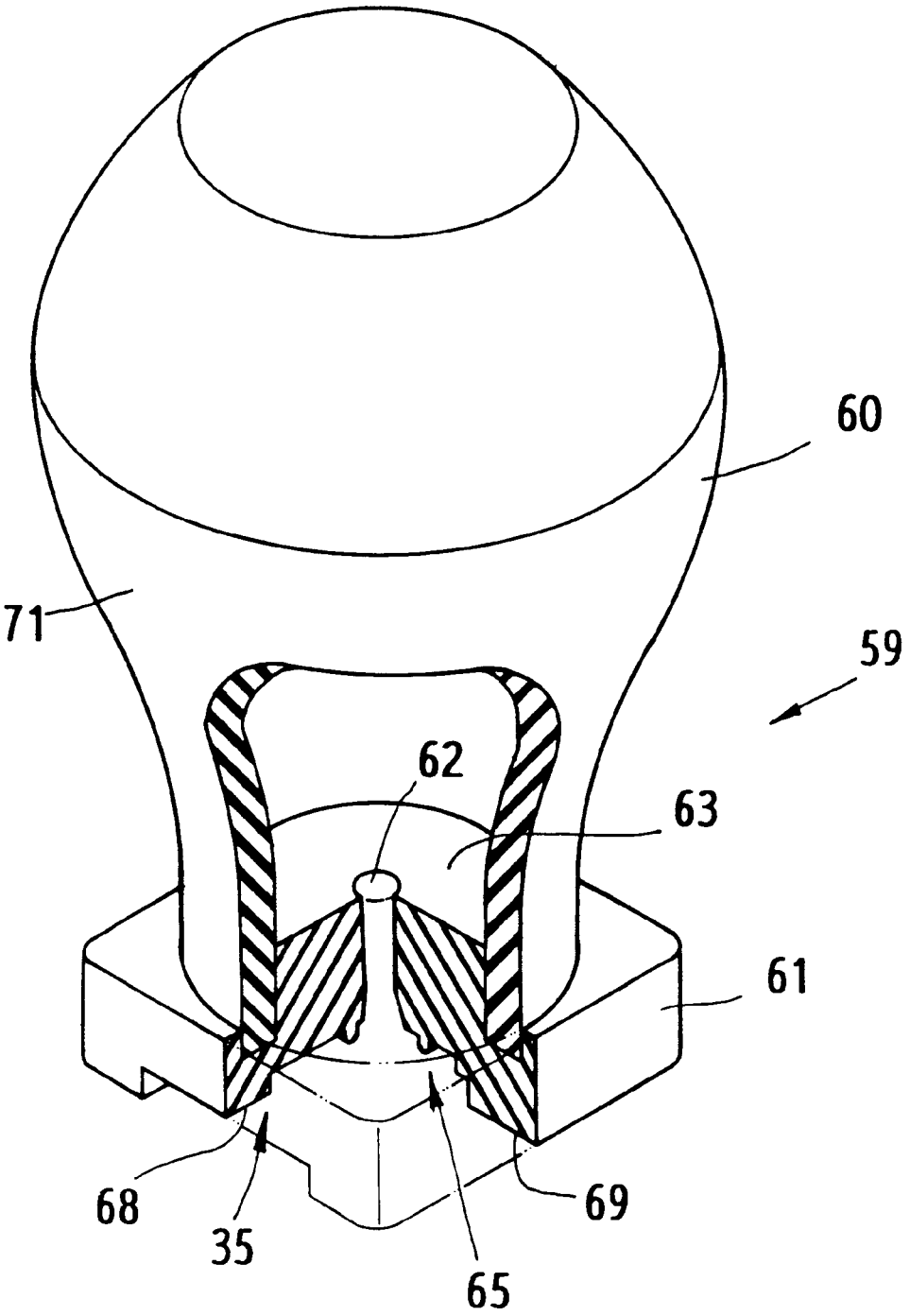
FIG. 8 is a perspective and sectional view of the present invention, showing a compression ball used as the suck assembly.
Figure 9:
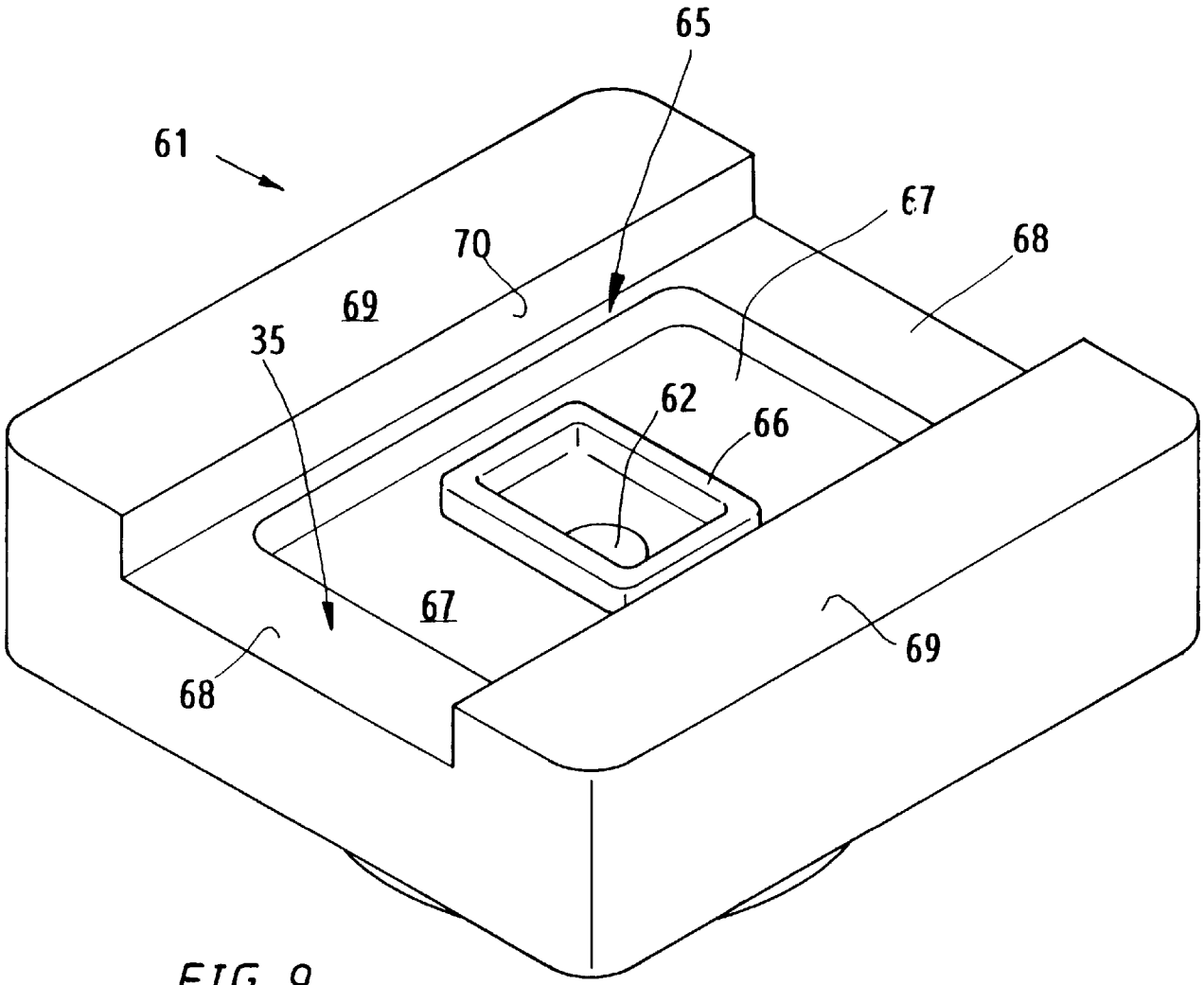
FIG. 9 is a perspective view of the present invention, showing the structural relation between the hermetic assembly and the contact surface of the printing head.

Referring to FIGS. 6 to 8, the suck assembly 59 includes a compression unit 60 and a hermetic assembly 61; the hermetic assembly 61 has a hermetic-connection ring 66 to be in close contact with the printing head 13 and a second hermetic surface 35; the center of the hermetic assembly 61 has a through hole 62, of which one end is designed into a form for mating with the bottle mouth 34 of an ink bottle 33 in the event of the compression unit 60 being an ink bottle 33; as shown in FIG. 7, the bottle mouth 34 of the ink bottle 33 can be connected with the central through hole 62 of the hermetic assembly 61. The air in the second chamber 40 of the ink cartridge 11 can be sucked out by means of the resilient effect of the ink bottle 33 upon being compressed. The through hole 62 of the hermetic assembly 61 may also be designed into a form for mating with a compression ball 71 in the event of the compression unit 60 being such compression ball 71 as shown in FIG. 8; in that case, the opening of the through hole 62 is substantially a straight round hole. The bottom of the cylinder portion 63 has a ring-shaped groove 64; the outer diameter of the cylinder portion 63 is so designed that it can be hermetically connected with the opening end of the compression ball 71, and the opening end can be mounted right in the ring shaped groove 64, and then they are glued together. By means of the resilient effect of the compression ball 71, the air in the second chamber 40 of the ink cartridge 11 can be sucked out.

Figure 10:
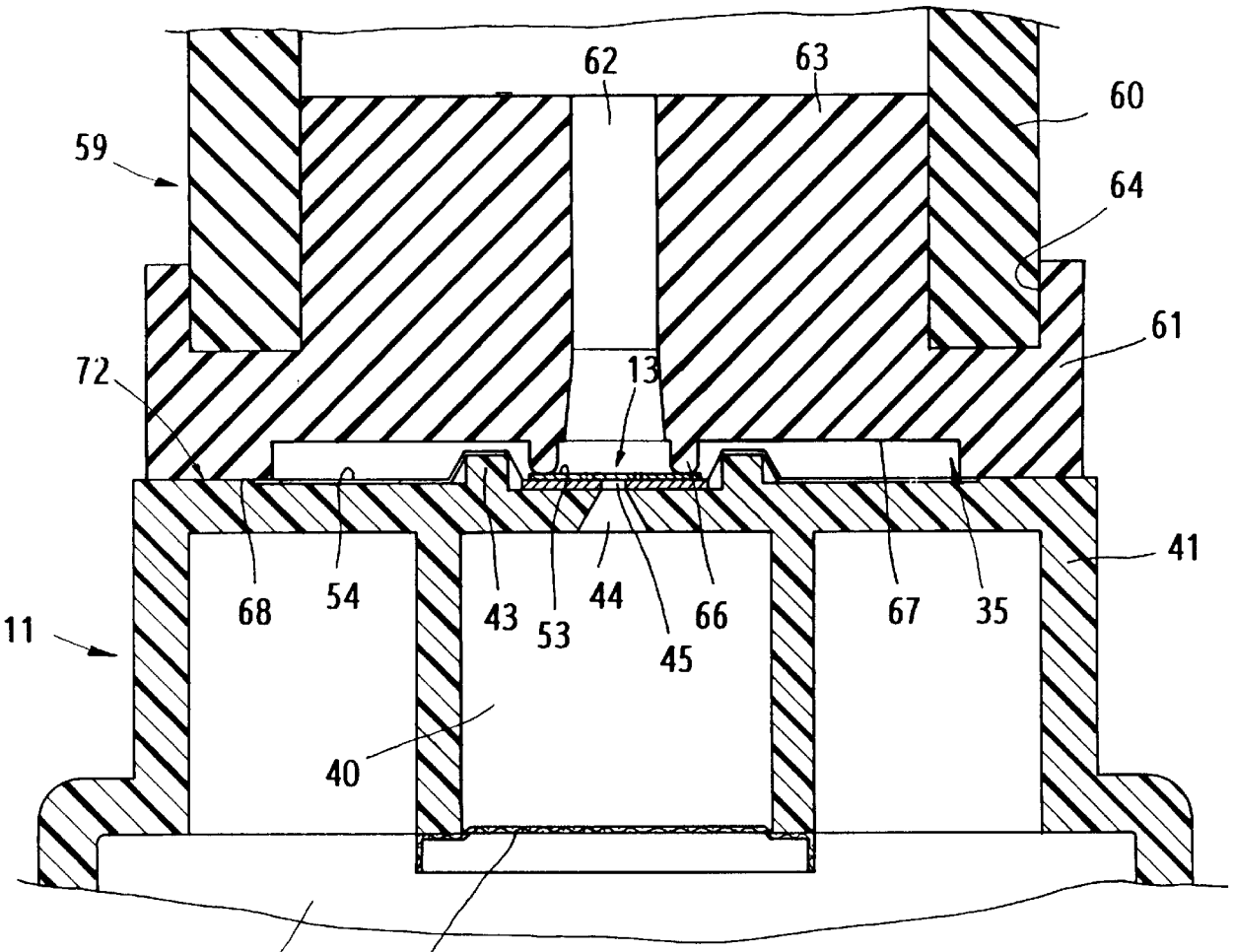
FIG. 10 is a sectional view of the present invention, showing the first embodiment of the hermetic-connection ring of the hermetic assembly.
Figure 11:
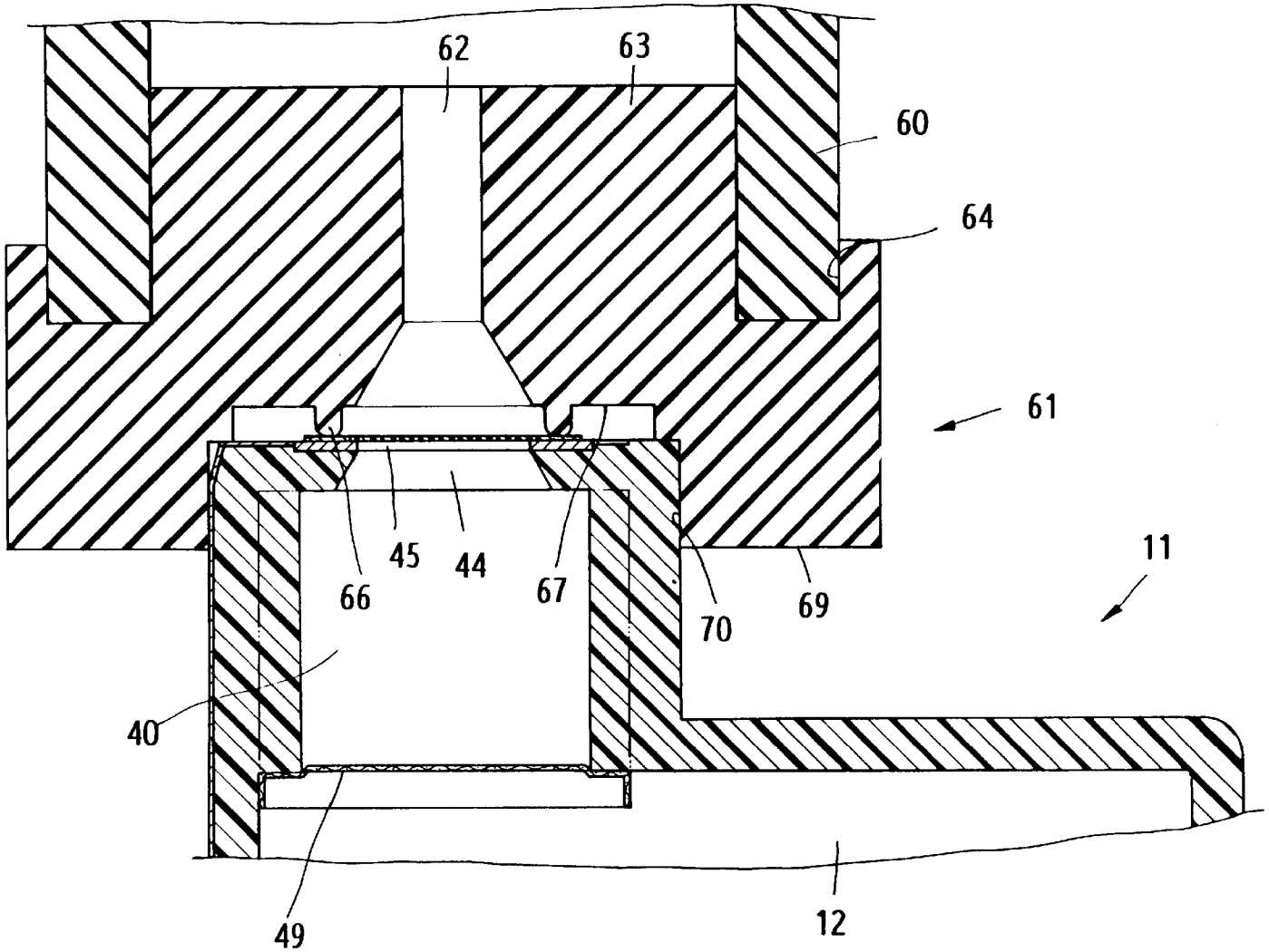
FIG. 11 is a sectional view of the present invention, showing the hermetic relation between the second hermetic surface of the hermetic assembly in FIG. 10 and the printing head of the ink cartridge.
Figure 12:
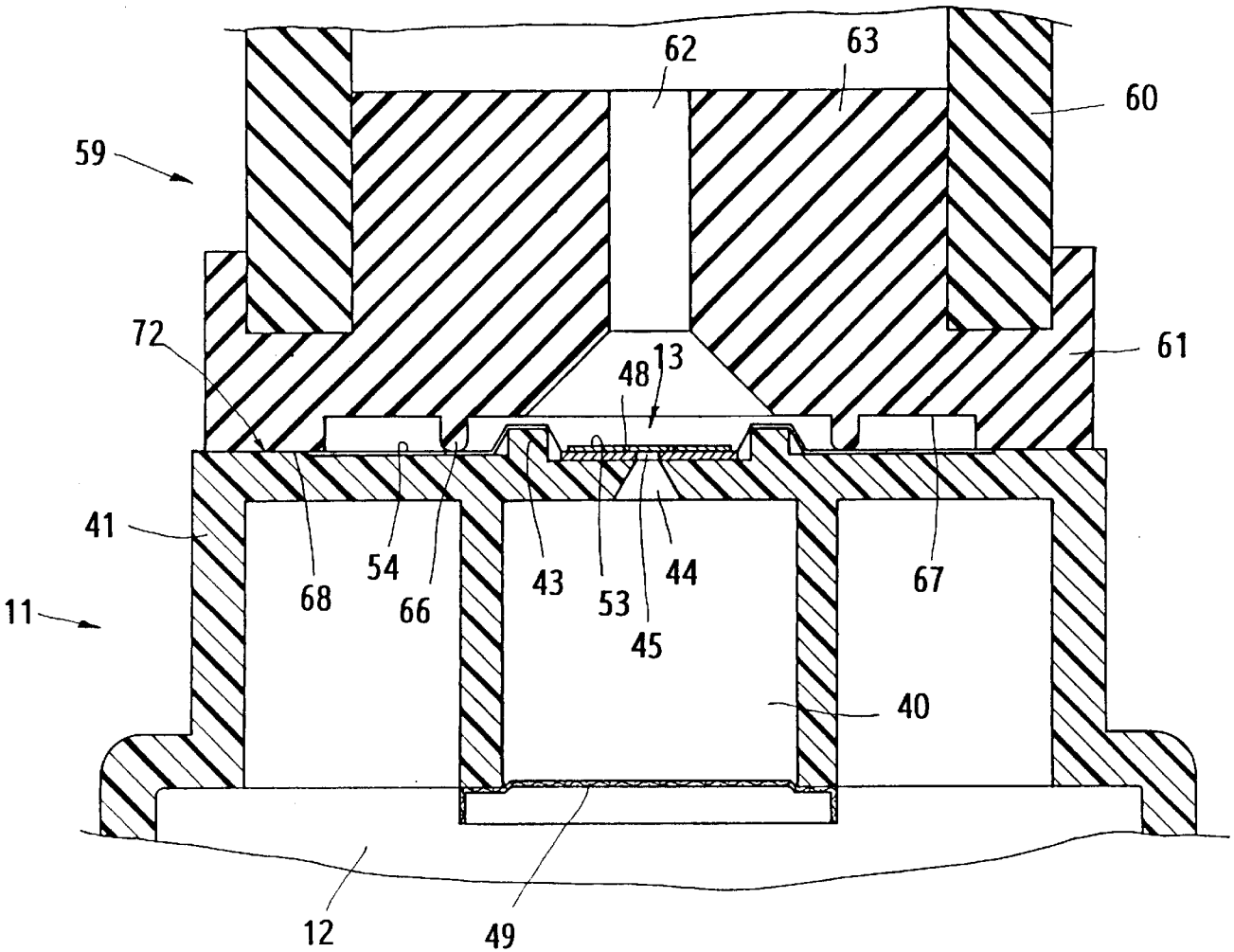
FIG. 12 is a sectional view of the present invention, showing the second embodiment of the hermetic-connection ring of the hermetic assembly.
Figure 13:
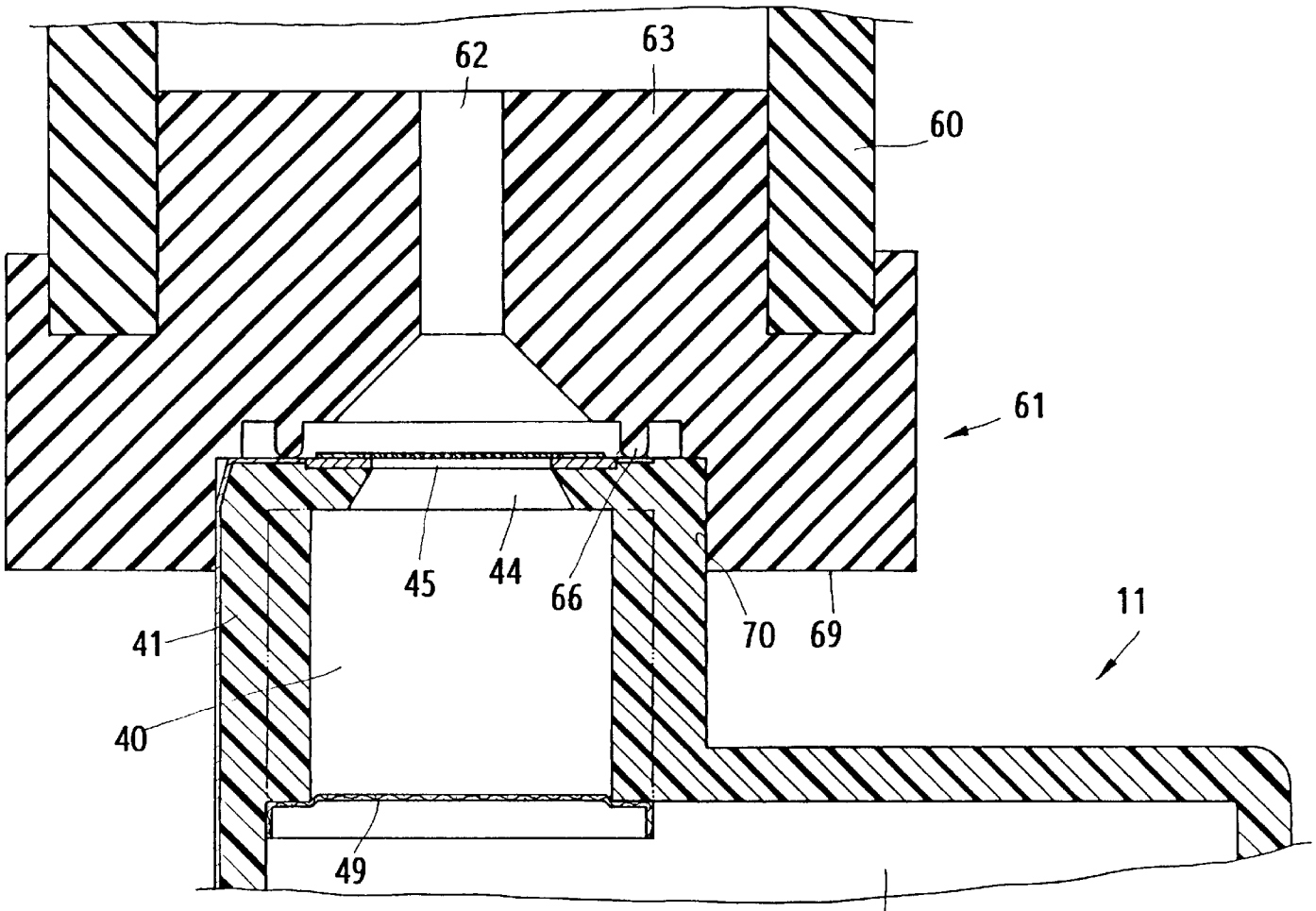
FIG. 13 is a sectional view of the present invention, showing the hermetic relation between the second hermetic surface of the hermetic assembly in FIG. 10 and the printing head of the ink cartridge.

Referring to FIGS. 5, 8 to 13, the hermetic assembly 61 of the suck assembly 59 are made of a resilient rubber. The contact surface 65 facing the printing head 13 of the ink cartridge 11 has a rectangular hermetic-connection ring 66 and a second hermetic surface 35; the hermetic-connection ring 66 as shown in FIGS. 10 and 11 has a flat surface 53 to be fitted to the hole plate 47 of the printing head 13 of the ink cartridge 11; when the hermetic assembly 61 is connected with the printing head 13, the hermetic-connection ring 66 will be in close contact with the flat surface 53 of the hole plate 47; then, the spray holes 48 in the hole plate 47 will be set inside the rectangular hermetic-connection ring 66 so as to seal the edge portion of the spray holes 48, and to provide a vacuum pumping of the compression unit 60 of the suck assembly 59 as well; then, the air in the second chamber 40 of the ink cartridge 11 will be sucked out completely. The rectangular hermetic-connection ring 66 of the hermetic assembly 61 as shown in FIGS. 12 and 13 has a flat surface 54 formed with a protection layer 38 on outer edge of the circuit assembly 39 around the printing head 13 of the ink cartridge 11. When the hermetic assembly 61 is mounted on the printing head 13, the rectangular hermetic-connection ring 66 and the flat surface 54 on outer edge of the protection layer 38 will be in close contact each other hermetically; then, the spray holes 48 in the hole plate 47 will be located within the rectangular hermetic-connection ring 66 to form into an isolation layer. By means of the compression unit 60 of the suck assembly 59, air in the second chamber 40 of the ink cartridge 11 can be sucked out.

The center of the hermetic assembly 61 of the suck assembly 59 has a rectangular hermetic-connection ring 66; the inner round edge of the hermetic-connection ring 66 extends to the through hole 62, while the bottom of the outer round edge thereof has a recess groove 67 with a suitable width so as to provide the hermetic-connection ring 66 with a suitable height and a suitable resilience after the same being connected with the printing head 13. The outer edge of the hermetic-connection ring 66 has a second hermetic surface 35, which is to fit to the shape of the body part 41 of the second chamber 40 in the ink cartridge 11. The body part 41 of the ink cartridge 11 is substantially a rectangular member; the second hermetic surface 35 is furnished with a flat-contact surface 68 on the flat surface 72 on both sides of the body part 41 of the printing head 13; both sides of the body part have short flat surfaces respectively so as to provide a higher and thick wall surface 69; the wall surface 69 is mounted firmly around the body part 41. When the inner wall surface 70 of the wall surface 69 is connected with the printing head 13, the wall surface 69 can be used as a guide for the hermetic assembly 61 so as to provide a better hermetic contact on both sides of the body part 41 of the printing head 13.

After the suck assembly 59 and the printing head 13 of the ink cartridge 11 are connected, the flat-contact surface 68 and the wall surface 69 on both sides of the second hermetic surface 35 can provide the suck assembly 59 with a quick connection with the printing head 13. During the quick connection, the rectangular hermetic-connection ring 66 of the hermetic assembly 61 will be in close contact with the outer flat surface 53 of the hole plate 47 of the printing head 13 or the outer flat surface 54 of the protection layer 38 of the circuit assembly 39. By means of the second hermetic surface 35 of the hermetic assembly 61, the flat-contact surface 68 and the wall surface 69, the hermetic contact between the outer flat surface 72 and the edge surface of the second chamber 40 will be strengthened.

When the compression unit 60 of the suck assembly 59 is an empty ink bottle 33, the hermetic assembly 61 can be connected hermetically on the body of the printing head 13 by means of the hermetic-connection ring 66 and the second hermetic surface 35. After the empty ink bottle 33 is compressed, the bottle mouth 34 thereof will be plugged into the central through hole 62 of the hermetic assembly 61; then, release the empty ink bottle 33 to let the bottle restore its original shape; in that case, the air in the second chamber 40 of the ink cartridge 11 will be sucked out slowly until the ink passing the storage chambers 52 of every sprayers 46. By means of the empty ink bottle 33 to suck the air in the second chamber 40, it is usually unable to remove all air therein once, i.e., it has to repeat suck sucking step several times and to connect with the hermetic assembly 61 several times.

After the ink cartridge 11 filled with ink is mounted on the printer, the ink is isolated in the prime chamber 12 by means of a mesh 49.Since there is no air in the second chamber 40, the ink on both sides of the mesh 49 can flow from the second chamber 40 and the passage 45 defined by the bearing member to enter the storage chambers 52 of every sprayer 46 as a result of siphon effect and a pressure-balance unit in the prime chamber 12; then, the ink can be controlled to spray out by means of a signal sent out of the circuit assembly 39.

When the compression unit 60 of the suck assembly 59 is a compression ball 71, the ball 71 on the hermetic assembly 61 has to be compressed before connecting with the printing head 13 of the ink cartridge 11; the flat-contact surface 68 of the second hermetic surface 35 of the hermetic assembly 61 and the two wall surfaces 69 can provide a guidance and positioning effect so as to have a hermetic contact between the hermetic-connection ring 66 of the hermetic assembly 61 and the outer flat surface 53 of the hole plate 47 or the outer flat surface 54 of the protection layer 38. The second hermetic surface 35 is instrumental in strengthening the hermetic contact of the body part 41. When the compression ball 71 is released, a vacuum pumping will take place to suck air out of the second chamber 40 until ink entering the storage chambers 52 of every sprayer 46; however, the compression ball 71 mounted together with the hermetic assembly 61 is unable to suck out all air from the second chamber 40 at one time; in other words, the hermetic assembly 61 separate from the Printing head 13 several times so as to compress the compression ball 71 repeatedly and to connect with the ball hermetically in order to suck air out of the second chamber 40 completely. The repeated separation and connection between the hermetic assembly 61 and the printing head 13 can be made correctly by means of the guidance and positioning effect furnished with the second hermetic surface 35 of the hermetic assembly 61, and then the air in the second chamber 40 can be sucked out quickly and completely.

Figure 14:
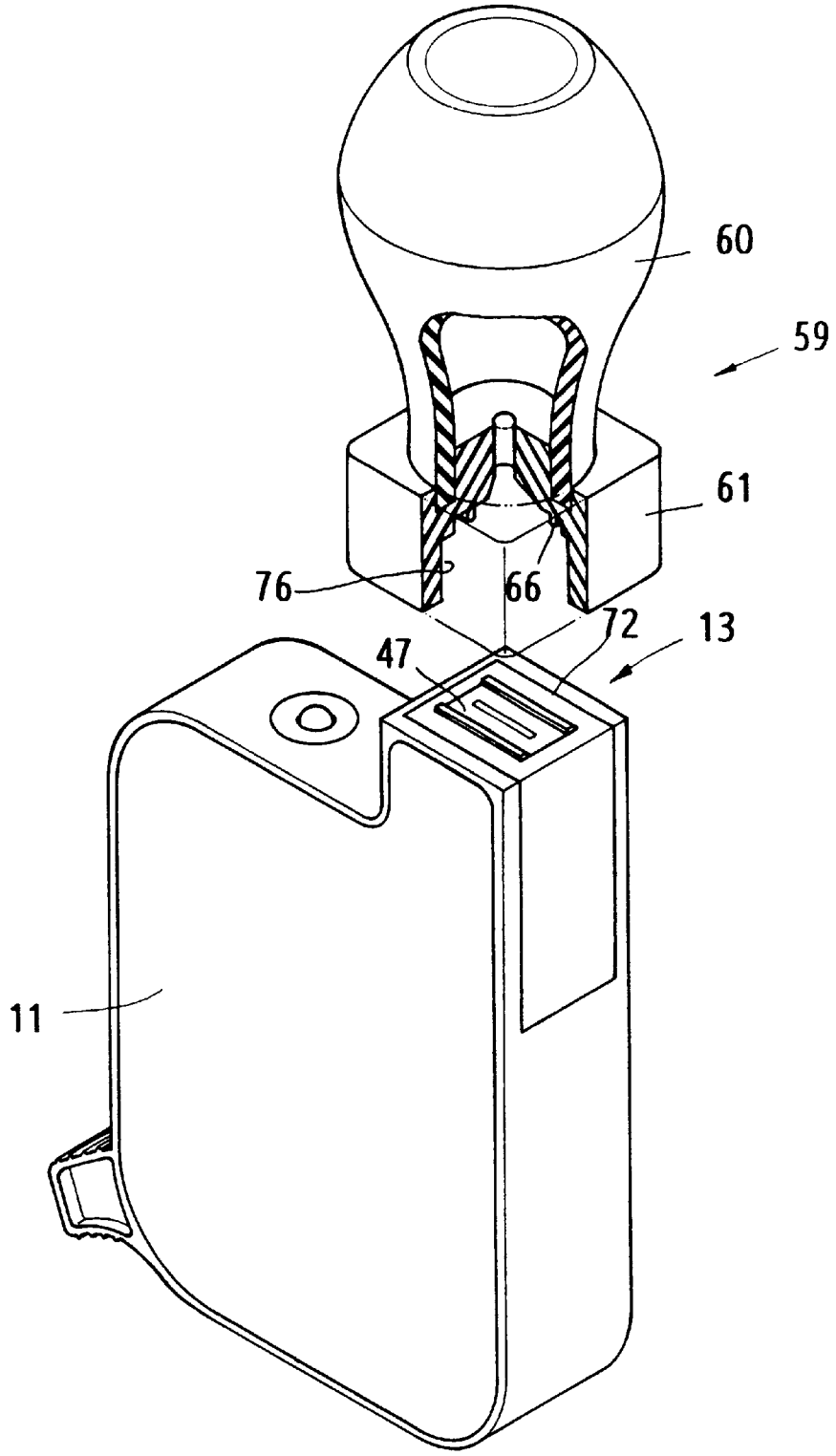
FIG. 14 is a sectional view of the present invention, showing the relation between the suck assembly and the second ink cartridge.
Figure 15:
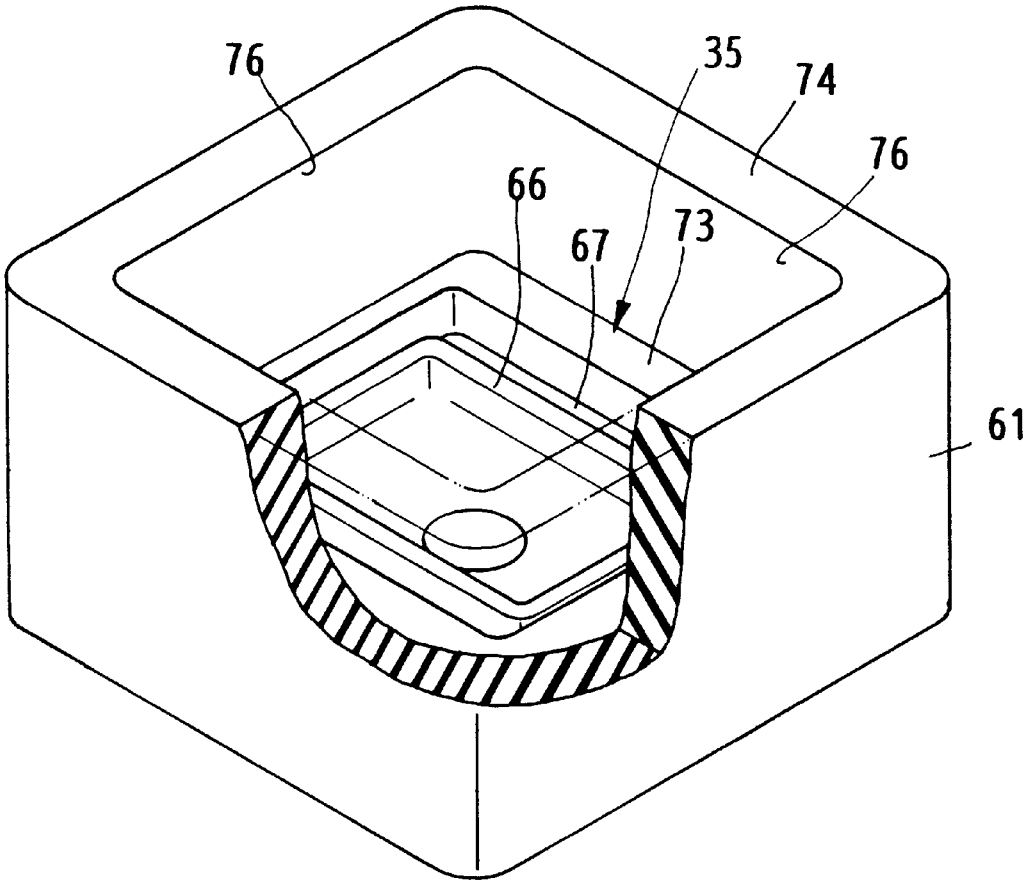
FIG. 15 is a sectional view of the present invention, showing the relation between the hermetic assembly and the contact surface of the printing head.

Referring to FIGS. 14 and 15, the hole plate 47 of the printing head 13 of the ink cartridge 11 is a rectangular member. When the rim of the body part 41 is a rectangular member, the hermetic-connection ring 66 in the center of the hermetic assembly 61 should be designed to fit the size of the flat surface 53 around the spray hole 48 of the hole plate 47 in the printing head 13, or the size of the flat surface 54 of the protection layer 38 of the circuit assembly 39; in other words, the structure of the hermetic-connection ring 66 should be done in accordance with the method as mentioned above. On the second hermetic surface 35 of the hermetic-connection ring 66, the two elongate sides of the hole plate 47 are furnished with two flat-contact surfaces 73 respectively; the outer rim of the flat-contact surface 73 is furnished with an outer-wall surface 74 so as to fit to the shape of rim of the body part 41. The inner-wall surface 76 of the outer-wall surface 74 is to fit to the rim of the square body part 41 so as to strengthen the hermetic seal between the hermetic assembly 61 and the second chamber 40. When the hermetic assembly 61 is to connect with the printing head 13 of the ink cartridge 11, the second hermetic surface 35 outside the hermetic assembly 61 will provide a guidance and positioning effect by means of the outer-wall surface 74 so as to make a quick connection for the body part 41 of the printing head 13 of the ink cartridge 11; then, the compression unit 60 will be used for sucking air out the second chamber 40 of the ink cartridge 11.

According to the aforesaid method, it is understood that the present invention is designed to prevent from ink interruption in a printing head of an ink cartridge in a printer; when ink is refilled into the prime chamber 12 of the ink cartridge 11, the ink is unable to enter the second chamber 40 having an isolation effect. The air in the second chamber 40 can be sucked out quickly by using the suck assembly 59 so as to have the ink in the prime chamber 12 entered the second chamber 40, and to have the ink flowed to the storage chambers 52 of every sprayer 46 of the printing head 13, and then a signal sent out of the circuit assembly will control the ink to spray; simutaneously, the suck assembly 59 also can have the ink in the second chamber 40 flowed quickly, through the passage 45 defined by the bearing member, to the storage chambers 52 of every sprayer 46 by means of vacuum-pumping method during the printing head 13 being cleaned; the ink will replace the ink drops contaminated by the detergents in the spray holes 48 and the storage chambers 52.

In the present invention, the method and technique are different from that of the front-end connection structure of the conventional compression ball 71. In the aforesaid embodiments, the structure relation and features between the hermetic assembly and the hole plate 47 of the printing head 13 on the ink cartridge 11 and the rim thereof have been disclosed completely. It is apparent that the present invention has provided with considerable improvement and innovation, which can provide with objects as expected, and have been known by the same industrial circle to be carried out easily.

What is claimed is:

1. A device for preventing from ink interruption in a printing head of an ink cartridge in a printer comprising:

a compression unit, of which one end facing a hermetic assembly having a bottle mouth, while other end thereof furnished with a compressible and resilient-empty member; one end of said bottle mouth connected with one end of said hermetic assembly;

said hermetic assembly made of a resilient material, and center thereof having a through hole, of which a contact side facing said printing head including:

a rectangular hermetic-connection ring, of which inner rim extended from said through hole, and said rectangular ring being fitted a shape of a spray hole of a hole plate of said printing head, and rectangular end of said hermetic-connection ring being in close contact with outer flat surface of said spray hole of said hole plate in said printing head;

a hermetic surface located around outer rim of said rectangular hermetic-connection ring and to fit rim of a body part of said printing head, and having at least two symmetrical wall surfaces so as to clamp over two symmetrical side surfaces of said body part of said printing head in said ink cartridge; inner edge of said wall surfaces furnished with flat-contact surface to be in close contact with an outer flat surface of said printing head.

2. A device for preventing from ink interruption in a printing head of an ink cartridge in a printer as claimed in claim 1, wherein said one end of said hermetic assembly is fitted bottle mouth of an ink of said compression unit bottle so as to facilitate said bottle mouth connected closely with said through hole of said hermetic assembly.

3. A device for preventing from ink interruption in a printing head of an ink cartridge in a printer as claimed in claim 1, wherein said hermetic assembly mounted on one end with said compression unit has an end furnished with a cylinder portion around an outer edge of said through hole of said hermetic assembly, and having a suited diameter, bottom of said cylinder portion furnished with a ring-shaped groove, and an outer diametic surface of said cylinder portion to be connected together with an opening end of a compression ball, and then said opening end being glued in said ring-shaped groove by means of a glue.

4. A device for preventing from ink interruption in a printing head of an ink cartridge in a printer as claimed in claim 1, wherein the center of said hermetic assembly has said rectangular hermetic-connection ring, of which bottom having a recess groove within said hermetic surface.

5. A device for preventing from ink interruption in a printing head of an ink cartridge in a printer as claimed in claim 1, the center of said hermetic assembly has said rectangular hermetic-connection ring, which being fitted an outer flat surface of said hole plate of said printing head in said ink cartridge, and when making a connection with said printing head, said hermetic-connection ring and the outer flat surface of said spray hole of said hole plate being in a hermetic contact.

6. A device for preventing from ink interruption in a printing head of an ink cartridge in a printer as claimed in claim 1, wherein the center of said hermetic assembly has said rectangular hermetic-connection ring, which being fitted a flat surface of a protection layer outside a circuit assembly around said printing head so as to provide a close and hermetic contact between said rectangular hermetic-connection ring and a flat surface on outer edge of said protection layer of said circuit assembly.

7. A device for preventing from ink interruption in a printing head of an ink cartridge in a printer as claimed in claim 1, wherein said hermetic surface outside said rectangular hermetic-connection ring of said hermetic assembly has two equal height flat-contact surfaces on both sides of said hermetic-connection ring, extended towards two sides thereof; both sides of said central hermetic-connection ring having higher wall surfaces, and an inner wall surface thereof to be clamped over two sides of said body part of said printing head for better positioning.

8. A device for preventing from ink interruption in a printing head of an ink cartridge in a printer as claimed in claim 1, wherein said hermetic surface around an outer edge of said rectangular hermetic-connection ring in said hermetic assembly has an outer-wall surface on rim of said body part of said printing head, and inner-wall surface of said outer-wall surface being in close contact with rim of said body part of said printing head; an inner edge of said outer-wall surface furnished with a flat surface to be in close contact with an outer edge flat surface of said printing head.

* * * * *